US008081138B2

(12) United States Patent
Wu et al.

(10) Patent No.: US 8,081,138 B2
(45) Date of Patent: Dec. 20, 2011

(54) ANTENNA STRUCTURE WITH ANTENNA RADOME AND METHOD FOR RISING GAIN THEREOF

(75) Inventors: Chun Yih Wu, Taichung (TW); Shih Huang Yeh, Yunlin County (TW); Hung Hsuan Lin, Taipei (TW)

(73) Assignee: Industrial Technology Research Institute, Hsinchu County (TW)

( * ) Notice: Subject to any disclaimer, the term of this patent is extended or adjusted under 35 U.S.C. 154(b) by 267 days.

(21) Appl. No.: 11/931,251

(22) Filed: Oct. 31, 2007

(65) Prior Publication Data

US 2008/0129626 A1 Jun. 5, 2008

Related U.S. Application Data

(63) Continuation-in-part of application No. 11/606,893, filed on Dec. 1, 2006, now Pat. No. 7,884,778.

(51) Int. Cl.
*H01Q 1/40* (2006.01)

(52) U.S. Cl. ..... 343/873; 343/909; 343/700 MS

(58) Field of Classification Search ..... 343/872, 343/909, 700 MS, 873, 756
See application file for complete search history.

(56) References Cited

U.S. PATENT DOCUMENTS 4,479,128 A * 10/1984 Brunner et al. ..... 343/756
6,034,636 A * 3/2000 Saitoh ..... 343/700 MS

OTHER PUBLICATIONS

Wu et al., A Study of Using Meta-materials as Antenna Substrate to Enhance Gain, Progress in Electromagnetics Research, PIER 51, 295-328, 2005.*
Tayeb, G., et al, Compact Directive Antennas Using Metamaterials, Journal, Nov. 12, 2002, Journees Internationales de Nice sur les Antennes 2002 (Jina 2002).
Chinese Office Action dated Dec. 31, 2010 for 200810084464.X, which is a corresponding application, that cites US4479128A and US6034636A.

* cited by examiner

*Primary Examiner* — Douglas W Owens
*Assistant Examiner* — Dieu H Duong
(74) *Attorney, Agent, or Firm* — WPAT, P.C.; Anthony King

(57) ABSTRACT

An antenna structure includes a radiating element and an antenna radome. The antenna radome has at least one dielectric layer, which has an upper surface having many S-shaped metal patterns and a lower surface having many inverse S-shaped metal patterns corresponding to the S-shaped metal patterns. The S-shaped metal patterns are respectively coupled to the corresponding inverse S-shaped metal patterns to converge radiating beams outputted from the radiating element.

20 Claims, 14 Drawing Sheets

ANTENNA STRUCTURE WITH ANTENNA RADOME AND METHOD FOR RISING GAIN THEREOF

CROSS-REFERENCE TO A RELATED APPLICATION

This application is a Continuation-In-Part (CIP) of U.S. patent application Ser. No. 11/606,893 filed on Dec. 1, 2006.

BACKGROUND OF THE INVENTION

1. Field of the Invention

The invention relates in general to an antenna structure with an antenna radome and a method for raising a gain thereof, and more particularly to an antenna structure, which has an antenna radome, a high gain and a simple structure, and a method for raising a gain thereof.

2. Description of the Related Art

Recently, the wireless communication technology is developed rapidly, so the wireless local area network (Wireless LAN) or the wireless personal area network (Wireless PAN) has been widely used in the office or home. However, the wired network, such as a DSL (Digital Subscriber Line), is still the mainstream for connecting various wireless networks. In order to wireless the networks in the cities and to build the backbone network appliance between the city and the country with a lower cost, a WiMAX (Worldwide Interoperability for Microwave Access) protocol of IEEE 802.16a having the transmission speed of 70 Mbps, which is about 45 times faster than that of the current T1 network having the speed of 1.544 Mbps, is further proposed. In addition, the cost of building the WiMAX network is also lower than that of building the T1 network.

Because the layout of the access points in the backbone network is usually built in a long distance and peer-to-peer manner. Thus, the high directional antenna plays an important role therein so as to enhance the EIRP (Effective Isotropically Radiated Power) and to achieve the object of implementing the long distance transmission with a lower power. Meanwhile, the converged radiating beams can prevent the neighboring zones from being interfered. The conventional high directional antenna may be divided into a disk antenna and an array antenna. The disk antenna has an extremely high directional gain, but an extremely large size. So, it is difficult to build the disk antenna, and the disk antenna tends to be influenced by the external climate.

When the required directional gain of the array antenna increases, the number of array elements grows with a multiplier, the antenna area greatly increases, and the material cost also increases greatly. Meanwhile, the feeding network, which is one of the important elements constituting the antenna array, becomes complicated severely. The feeding network is in charge of collecting the energy of each of the antenna array elements to the output terminal as well as to ensure no phase deviation between the output terminal and each of the antenna array elements. Thus, the problems of phase precision and transmitted energy consumption occur such that the antenna gain cannot increase with the increase of the number of array elements.

In 2002, G. Tayeb etc. discloses a "Compact directive antennas using metamaterials" in 12th International Symposium on Antennas, Nice, 12-14 Nov. 2002, in which the metamaterial antenna radome having a multi-layer metal grid is proposed. The electromagnetic bandgap technology is utilized to reduce the half power beamwidth (only about 10 degrees) of the microstrip antenna greatly in the operation frequency band of 14 GHz, and thus to have the extremely high directional gain. Based on the equation of $c=f\times\lambda$, however, when the antenna is applied in a WiMAX system with the operation frequency band of 3.5 GHz to 5 GHz, the wavelength is greatly lengthened because the frequency is greatly lowered. Thus, the antenna radome has to possess the relatively large thickness correspondingly, and the overall size of the antenna increases. Meanwhile, the multi-layer metal grid acts on the far-field of the antenna radiating field, so the overall size of the antenna structure increases and the utility thereof is restricted.

SUMMARY OF THE INVENTION

It is therefore an object of the invention to provide an antenna structure with an antenna radome and a method of raising a gain thereof. A dielectric layer formed with metal patterns is utilized such that the antenna radome made of a metamaterial may be placed in a near-field zone of the radiating field of the antenna structure. Thus, the beamwidth of the radiating beams of the antenna structure can be converged to increase the gain of the antenna structure and the size of the antenna structure can be greatly reduced.

The invention achieves the above-identified object by providing an antenna structure including a radiating element and an antenna radome. The antenna radome has at least one dielectric layer, which has an upper surface formed with a plurality of S-shaped metal patterns, and a lower surface formed with a plurality of inverse S-shaped metal patterns corresponding to the S-shaped metal patterns. The S-shaped metal patterns are respectively coupled to the corresponding inverse S-shaped metal patterns to converge radiating beams outputted from the radiating element.

The invention also achieves the above-identified object by providing another antenna structure including a radiating element and an antenna radome. The antenna radome has at least one dielectric layer, which has an upper surface formed with a plurality of metal patterns, and a lower surface formed with a plurality of inverse metal patterns corresponding to the metal patterns. A gap between the metal patterns ranges from 0.002 to 0.2 times of a wavelength of a resonance frequency of the radiating element, and a gap between the inverse metal patterns ranges from 0.002 to 0.2 times of the wavelength of the resonance frequency of the radiating element. The metal patterns are respectively coupled to the corresponding inverse metal patterns to converge radiating beams outputted from the radiating element.

The invention also achieves the above-identified object by providing an antenna radome including at least one dielectric layer, a plurality of S-shaped metal patterns and a plurality of inverse S-shaped metal patterns. The S-shaped metal patterns are formed on an upper surface of the at least one dielectric layer by way of printing or etching. The inverse S-shaped metal patterns respectively correspond to the S-shaped metal patterns and are formed on a lower surface of the at least one dielectric layer by way of printing or etching. The S-shaped metal patterns are respectively coupled to the corresponding inverse S-shaped metal patterns to converge radiating beams outputted from a radiating element.

The invention also achieves the above-identified object by providing an antenna radome including at least one dielectric layer, a plurality of metal patterns and a plurality of inverse metal patterns. The metal patterns are formed on an upper surface of the at least one dielectric layer by way of printing or etching. The plurality of inverse metal patterns respectively correspond to the metal patterns and are formed on a lower surface of the at least one dielectric layer by way of printing or etching. A gap between the metal patterns ranges from 0.002 to 0.2 times of a wavelength of a resonance frequency of a radiating element, and a gap between the inverse metal patterns ranges from 0.002 to 0.2 times of the wavelength of the resonance frequency of the radiating element. The metal patterns are respectively coupled to the corresponding inverse metal patterns to converge radiating beams outputted from the radiating element.

The invention also achieves the above-identified object by providing a method of raising a gain of an antenna structure. The method includes the steps of: providing a radiating element; and placing an antenna radome above the radiating element to converge radiating beams outputted from the radiating element. The antenna radome has at least one dielectric layer, which has an upper surface formed with a plurality of S-shaped metal patterns by way of printing or etching, and a lower surface formed, by way of printing or etching, with a plurality of inverse S-shaped metal patterns respectively corresponding to the S-shaped metal patterns. The S-shaped metal patterns are respectively coupled to the corresponding inverse S-shaped metal patterns to converge the radiating beams outputted from the radiating element.

For low profile consideration, the radiating element may use a planar inverted-F antenna (PIFA). In consideration of manufacturing, the radome may comprises three dielectric layers made of fiber glass such as FR4, and the thicknesses of the three dielectric layers are of a ratio of 1:1.3:1 to 1:1.7:1. Moreover, the radiating element may be a slot antenna for double-side radiation applications.

Other objects, features, and advantages of the invention will become apparent from the following detailed description of the preferred but non-limiting embodiment. The following description is made with reference to the accompanying drawings.

DETAILED DESCRIPTION OF THE INVENTION

The invention provides an antenna structure with an antenna radome and a method of raising a gain thereof. A dielectric layer formed with metal patterns is utilized such that the antenna radome can be placed in a near-field zone of a radiating field of the antenna structure. Thus, the beamwidth of the radiating beams of the antenna structure can be converged to increase the gain of the antenna structure.

Figure 1:
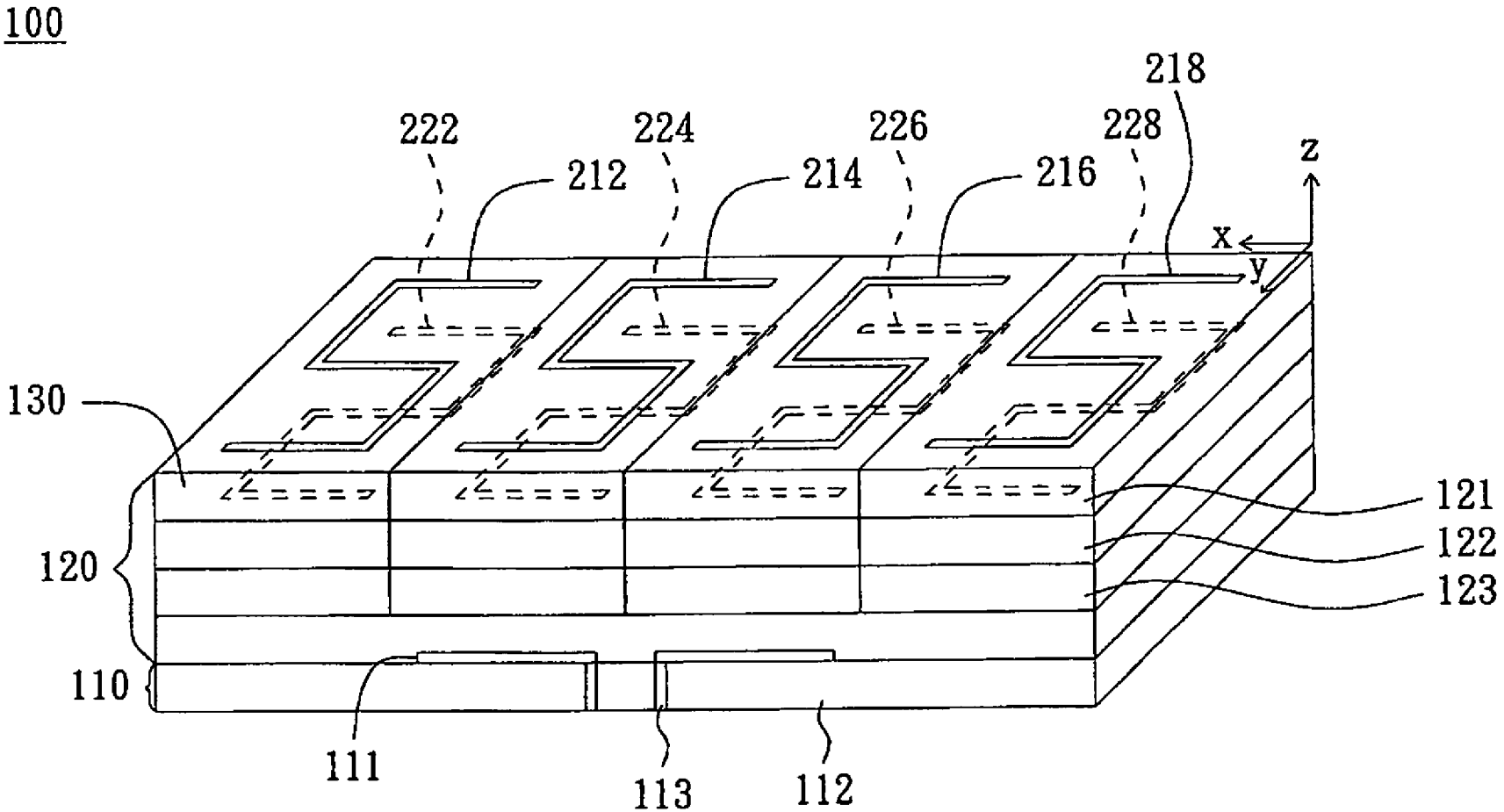
FIG. 1 is a schematic illustration showing an antenna structure according to a preferred embodiment of the invention.

FIG. 1 is a schematic illustration showing an antenna structure 100 according to a preferred embodiment of the invention. Referring to FIG. 1, the antenna structure 100 includes a radiating element 110 and an antenna radome 120. The radiating element 110 includes a radiating main body 111, a medium element 112 and an antenna feeding end 113. The radiating main body 111 is disposed on the medium element 112, and the antenna feeding end 113 feeds signals. The radiating element 110 may be any type of antenna and is not restricted to a specific type of antenna.

Figure 2B:
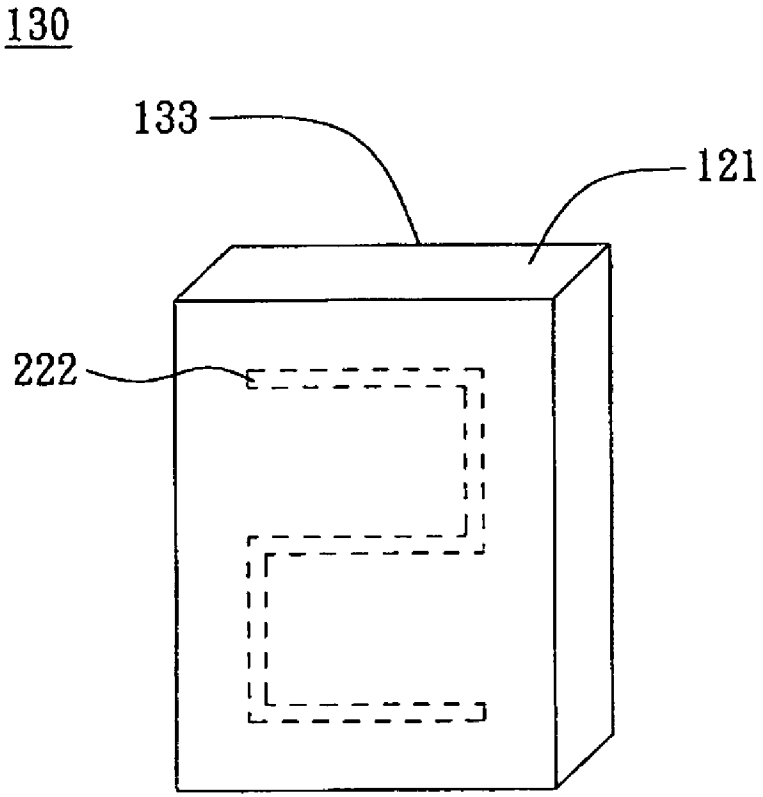
FIG. 2B is a schematic illustration showing a metal pattern on a backside of a single array element of the antenna structure according to the preferred embodiment of the invention.
Figure 2A:
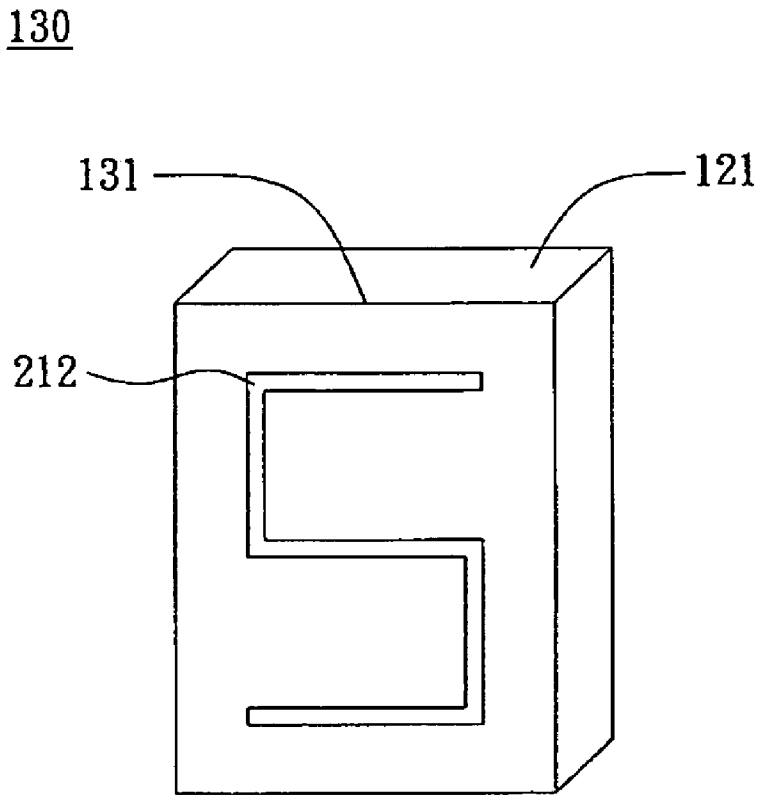
FIG. 2A is a schematic illustration showing a metal pattern on a face side of a single array element of the antenna structure according to the preferred embodiment of the invention.

The antenna radome 120 is made of a metamaterial, and has at least one dielectric layer. In this embodiment, the antenna radome 120 has, without limitation to, three dielectric layers including a dielectric material layer 121, a dielectric material layer 122 and a dielectric material layer 123. The upper surfaces of the dielectric material layers 121 to 123 are formed with multiple S-shaped metal patterns 212 to 218, and the lower surfaces of the dielectric material layers 121 to 123 are formed with multiple inverse S-shaped metal patterns 222 to 228 respectively corresponding to the S-shaped metal patterns 212 to 218. The antenna radome 120 may also be regarded as being composed of multiple array elements 130. FIG. 2A is a schematic illustration showing a metal pattern on a face side of a single array element of the antenna structure according to the preferred embodiment of the invention. Referring to FIG. 2A, the array element 130 includes the dielectric material layer 121 and has an upper surface 131 formed with the S-shaped metal pattern 212. FIG. 2B is a schematic illustration showing a metal pattern on a backside of a single array element of the antenna structure according to the preferred embodiment of the invention. Referring to FIG. 2B, the array element 130 includes the dielectric material layer 121 and has a lower surface 133 having the inverse S-shaped metal pattern 222.

In the antenna radome 120, a gap between the S-shaped metal patterns 212 to 218 ranges from 0.002 to 0.2 times of the wavelength of the resonance frequency of the radiating element 110. A gap between the inverse S-shaped metal patterns 222 to 228 ranges from 0.002 to 0.2 times of the wavelength of the resonance frequency of the radiating element 110. The S-shaped metal patterns 212 to 218 and the inverse S-shaped metal patterns 222 to 228, which are formed on the dielectric material layer 121 by way of printing or etching, have simple structures and may be manufactured using the current printed circuit board (PCB) process. So, the manufacturing cost thereof may be reduced greatly.

Figure 3A:
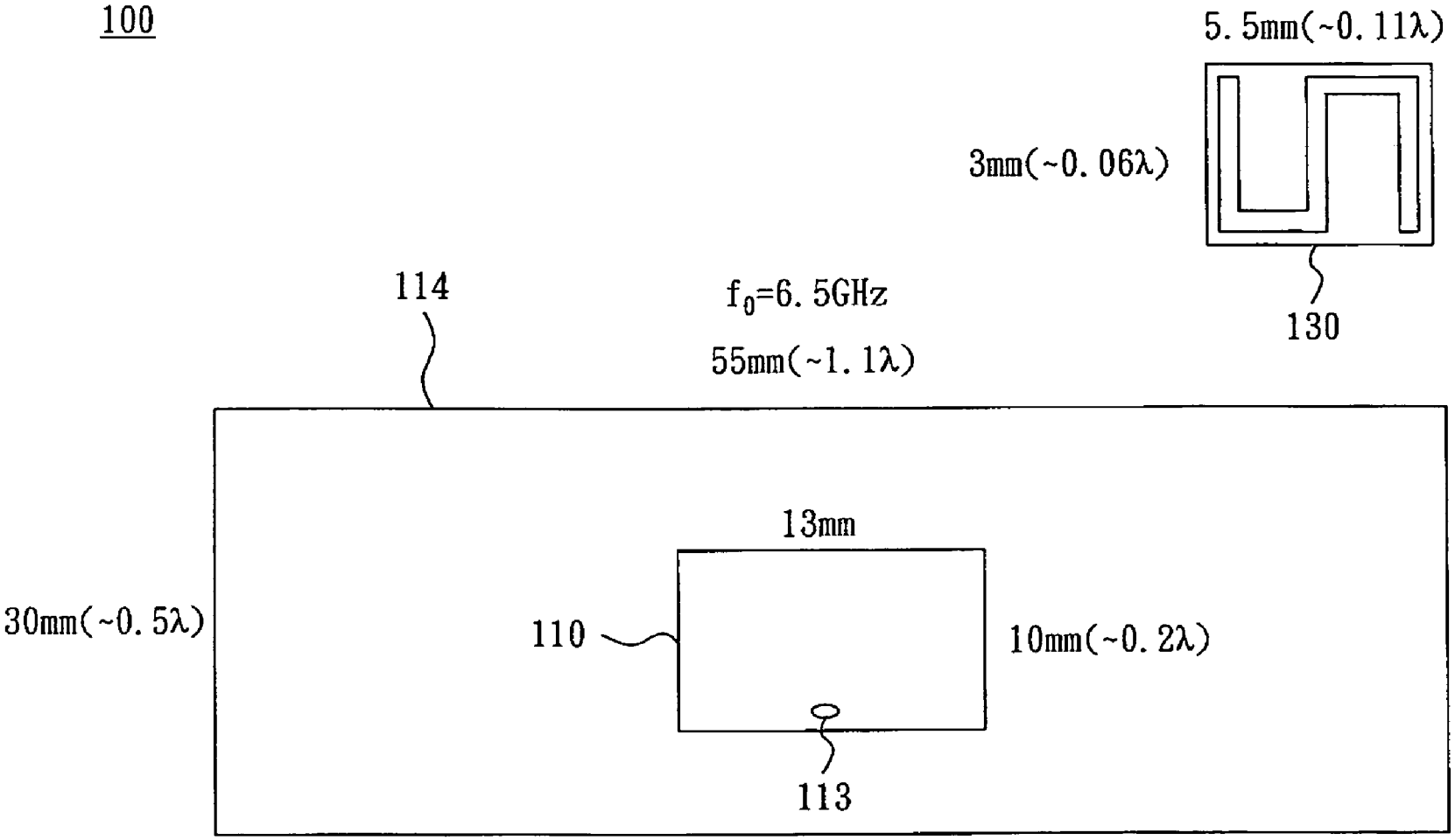
FIG. 3A is a top view showing the antenna structure according to the preferred embodiment of the invention.
Figure 3B:
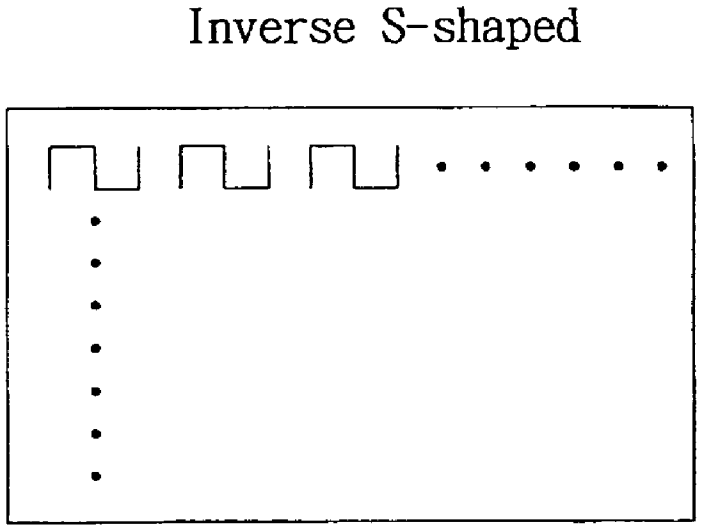
FIG. 3B is a schematic illustration showing an upper surface and a lower surface of a single layer of array element of the antenna structure according to the preferred embodiment of the invention.
Figure 3B:
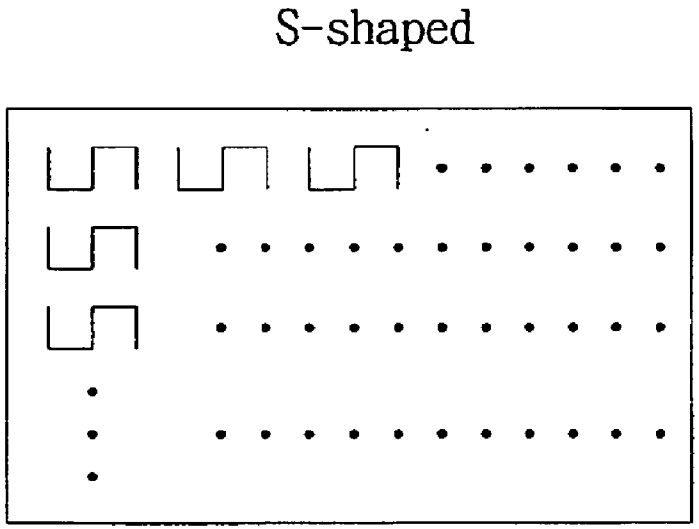

FIG. 3A is a top view showing the antenna structure according to the preferred embodiment of the invention. As shown in FIG. 3A, the antenna structure 100 of this embodiment has, without limitation to, 10×10 array elements. In this embodiment, the frequency is about 6.5 GHz. In this case, the size of the radiating element 110 is about 13 mm×10 mm (about 0.2 times of the wavelength), and the antenna feeding end 113 is disposed on the radiating element 110. In addition, the size of the array element 130 is about 5.5 mm (about 0.11 times of the wavelength)×3 mm (about 0.06 times of the wavelength). So, when the antenna structure 100 has 10×10 array elements, the size of a ground 114 is about 55 mm (about 1.1 times of the wavelength)×30 mm (about 0.5 times of the wavelength). FIG. 3B is a schematic illustration showing an upper surface and a lower surface of a single layer of array element of the antenna structure according to the preferred embodiment of the invention. As shown in FIG. 3B, the single layer of array element of the antenna structure 100 has an upper surface formed with multiple S-shaped metal patterns, and a lower surface formed with multiple inverse S-shaped metal patterns.

Figure 4:
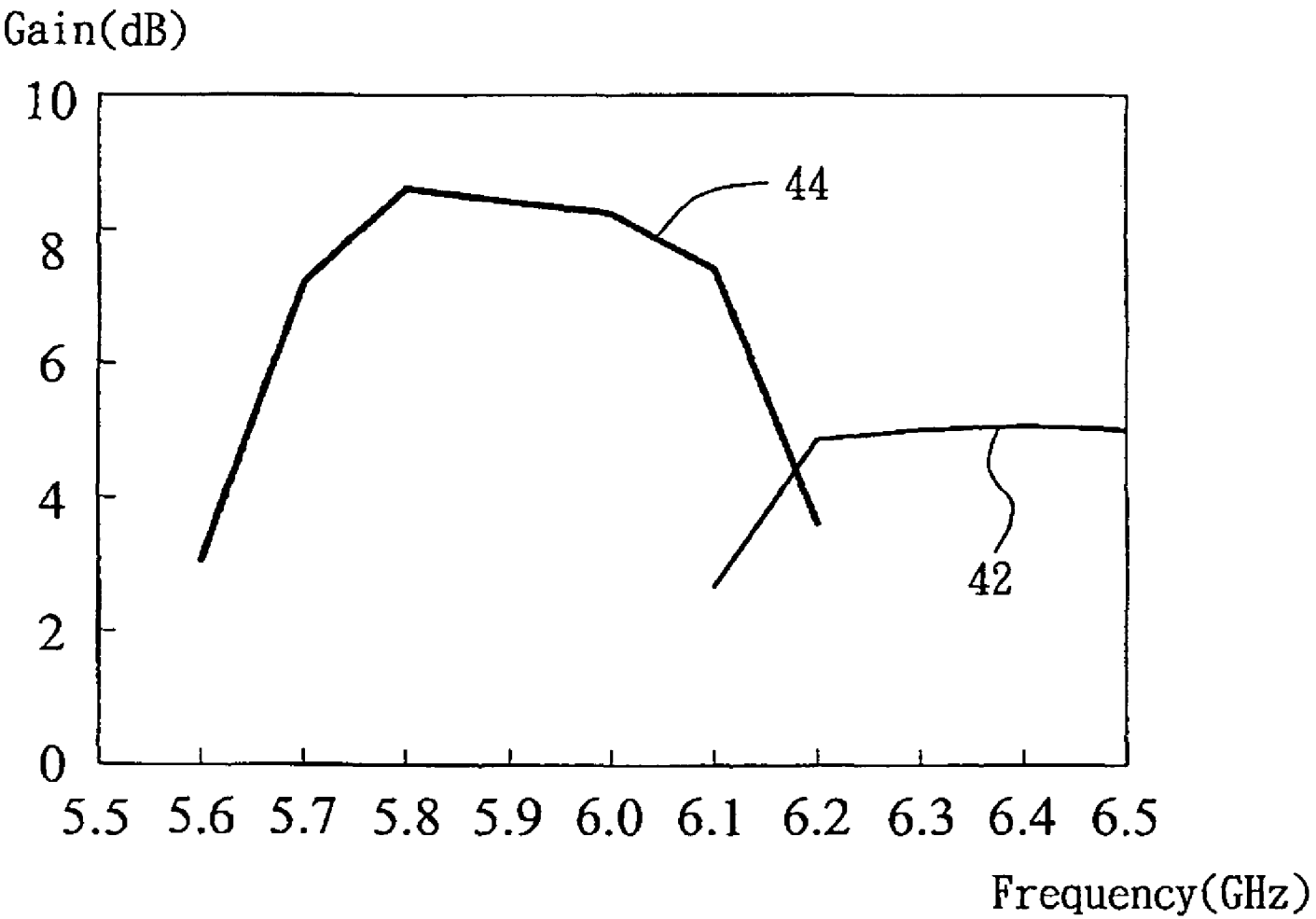
FIG. 4 shows a gain frequency response curve of the antenna structure according to the preferred embodiment of the invention.
Figure 5:
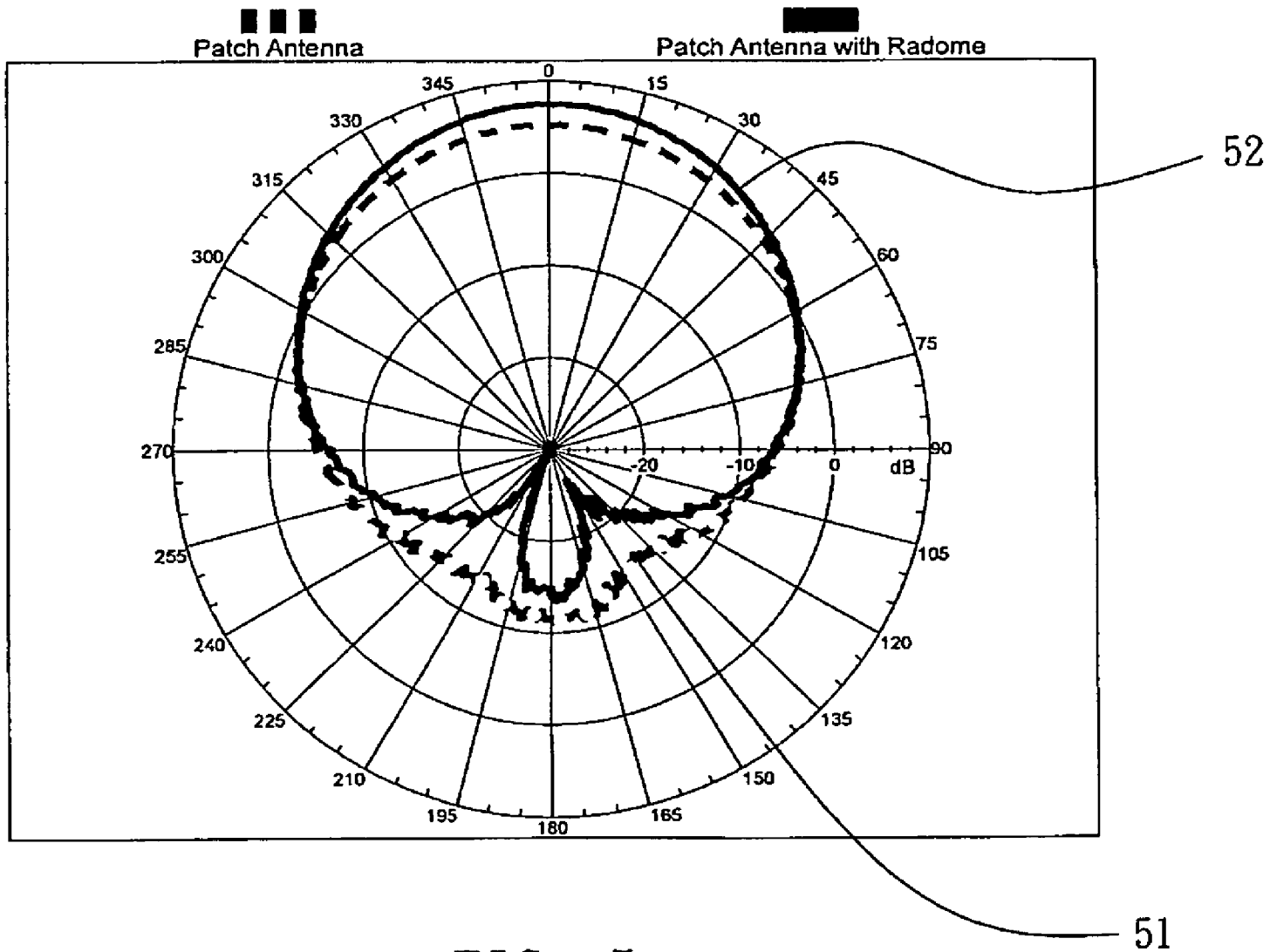
FIG. 5 shows a radiating pattern chart of the antenna structure according to the preferred embodiment of the invention.

The method of the invention for raising a gain of the antenna structure is to attach the antenna radome 120 to the radiating element 110 to converge the radiating beams emitted by the radiating element 110. The antenna radome 120 is placed at a near-field position of an electromagnetic field created by the radiating element 110. The S-shaped metal patterns 212 to 218 are respectively coupled to the corresponding inverse S-shaped metal patterns 222 to 228 to converge the radiating beams outputted from the radiating element 110, so that the beamwidth of the radiating beams is decreased, and the gain of the antenna structure 100 is increased. FIG. 4 shows a gain frequency response curve of the antenna structure according to the preferred embodiment of the invention. As shown in FIG. 4, the radiating element 110 is a microstrip antenna, the symbol 42 denotes the gain frequency response curve of the single microstrip antenna, and the symbol 44 denotes the gain frequency response curve of the antenna radome of the invention plus the microstrip antenna. As shown in FIG. 4, the single microstrip antenna has the maximum gain of 5.07 dBi at 6.4 GHz, and the antenna radome of the invention plus the microstrip antenna have the maximum gain of 8.61 dBi at 5.8 GHz. So, the gain of about 3.54 dBi is increased. FIG. 5 shows a radiating pattern chart of the antenna structure according to the preferred embodiment of the invention. The radiation pattern of FIG. 5 is measured based on the antenna structure 100 of the FIG. 1. The symbol 51 denotes the radiation property of the single microstrip antenna, and the symbol 52 denotes the radiation property of the antenna radome of the invention plus the microstrip antenna. As shown in FIG. 5, after the metal antenna radome is added, the embodiment generates the field type of converged radiation on the x-z plane, and is thus very suitable for the actual application of the directional antenna.

The metal patterns on the dielectric material layers 121 to 123 are not restricted to the S-shaped metal patterns and the inverse S-shaped metal patterns in the antenna structure 100 mentioned hereinabove. Any metal pattern having the gap ranging between 0.002 to 0.2 times of the wavelength of the resonance frequency of the radiating element 110 can be used in the antenna structure 100 of this invention as long as the metal patterns formed on the upper and lower surfaces can be coupled to each other. In addition, the dielectric constants and the magnetic coefficients of the dielectric material layers 121 to 123 may be the same as or different from one another in the antenna structure 100. For example, the magnetic coefficients of the dielectric material layer 121 and the dielectric material layer 123 are the same, but are unequal to the magnetic coefficient of the dielectric material layer 122. Alternatively, the magnetic coefficients of the dielectric material layers 121 to 123 may be different from one another. The relationships between the dielectric constants of the dielectric material layers 121 to 123 may also be similar to those of the magnetic coefficients. When the dielectric constants and the magnetic coefficients of the dielectric material layers 121 to 123 are different from one another, the gap between the S-shaped metal patterns and the gap between the inverse S-shaped metal patterns have to be adjusted slightly but still range from 0.002 to 0.2 times of the wavelength of the resonance frequency of the radiating element 110.

Figure 6:
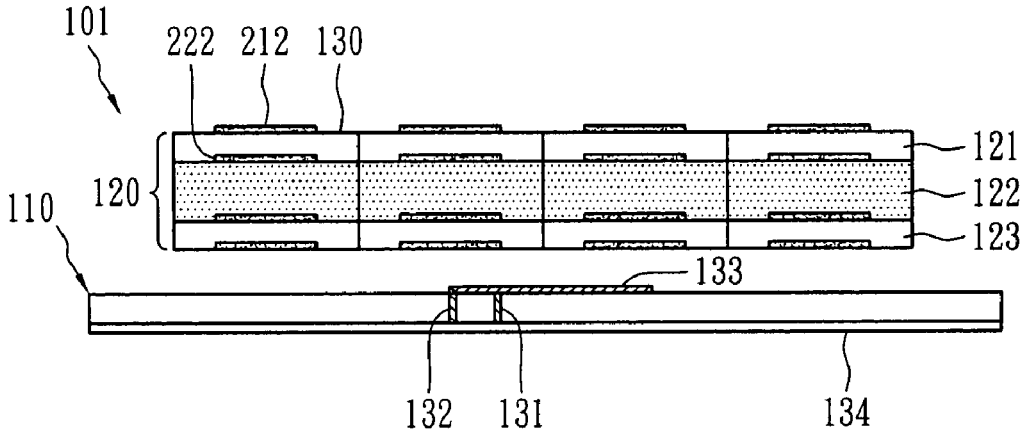
FIG. 6 is a schematic illustration showing an antenna structure according to an embodiment of the invention.

In an embodiment, the dielectric layers 121, 122 and 123 of FIG. 1 may use Roger 5880 substrate, which is costly and is difficult to be formed as a laminate. Therefore, cheaper fiber glass such as FR4 may be used for cost reduction. Moreover, the radiation element 110 may use a planar inverted-F antenna (PIFA) as shown in FIG. 6 so as to obtain a low profile antenna structure. The PIFA can be formed by pressing a metal plate directly, so PIFA can be manufactured with a lower cost and has less weight in comparison with a patch antenna. The FIFA antenna 110 is placed below the antenna radome 120 and comprises a signal feeding end 131, a shorting member 132, a radiation conductor 133 and a grounding plane 134. The antenna radome 120 comprises three dielectric layers 121, 122 and 123, which are preferably formed by fiber glass such as FR4. An S-shaped metal pattern 212 and an inverse S-shaped metal pattern 222 are formed on upper and lower surfaces of the dielectric layers 121 and 123 to form an array element 130. The antenna radome 120 may be composed of multiple array elements 130. In an embodiment, the thicknesses of the three dielectric layers 121, 122 and 123 are 0.33 mm, 0.48 mm and 0.33 mm, respectively. As such, the thicknesses of the dielectric layers 121, 122 and 123 are of a ratio of around 1:1.5:1. In practice, a ratio of around 1:1.3:1 to 1:1.7:1 also can be used according to actual adjustment. Because the electrical behavior of the metal patterns would be influenced by different dielectric constants of various dielectric materials, the thicknesses of the dielectric layers are adjusted as mentioned above to achieve equivalent electrical behavior in order to use fiber glass (FR4) as the dielectric material.

Figure 7:
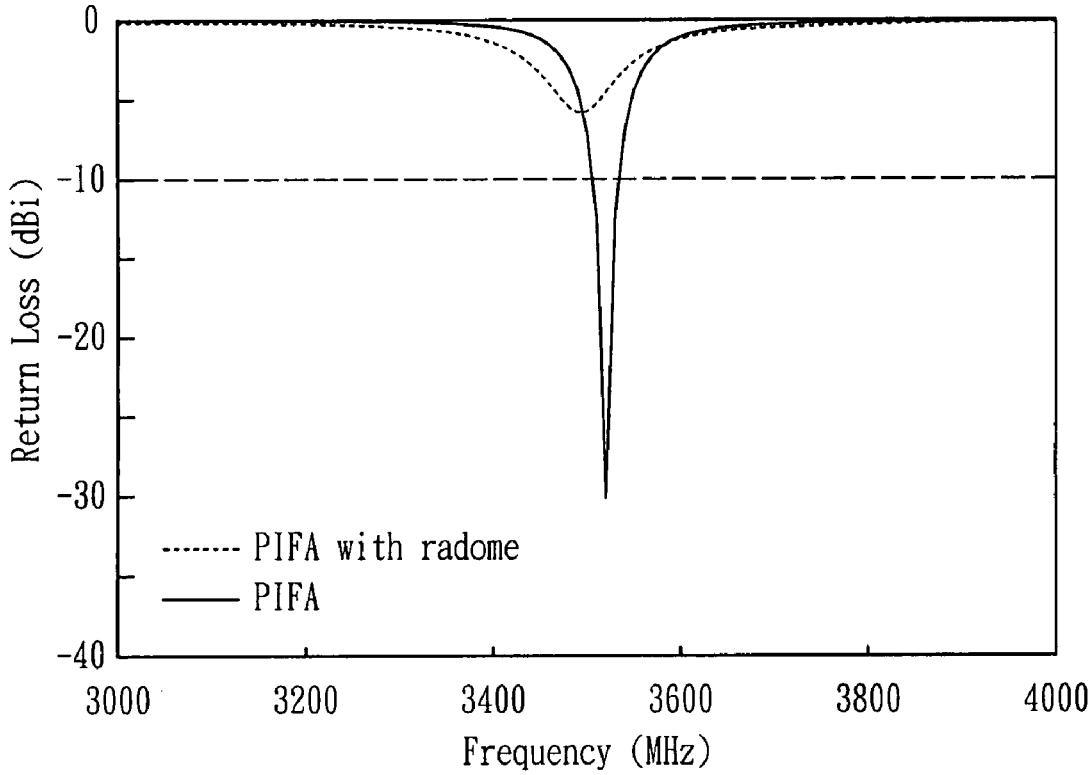
FIG. 7 and FIG. 8 show the antenna structure performance according to the embodiment of FIG. 6.

FIG. 7 illustrates the return loss in response to frequency of PIFA and PIFA with radome. It can be seen that the PIFA with radome of this embodiment has less return loss in comparison with that of the PIFA.

Figure 8:
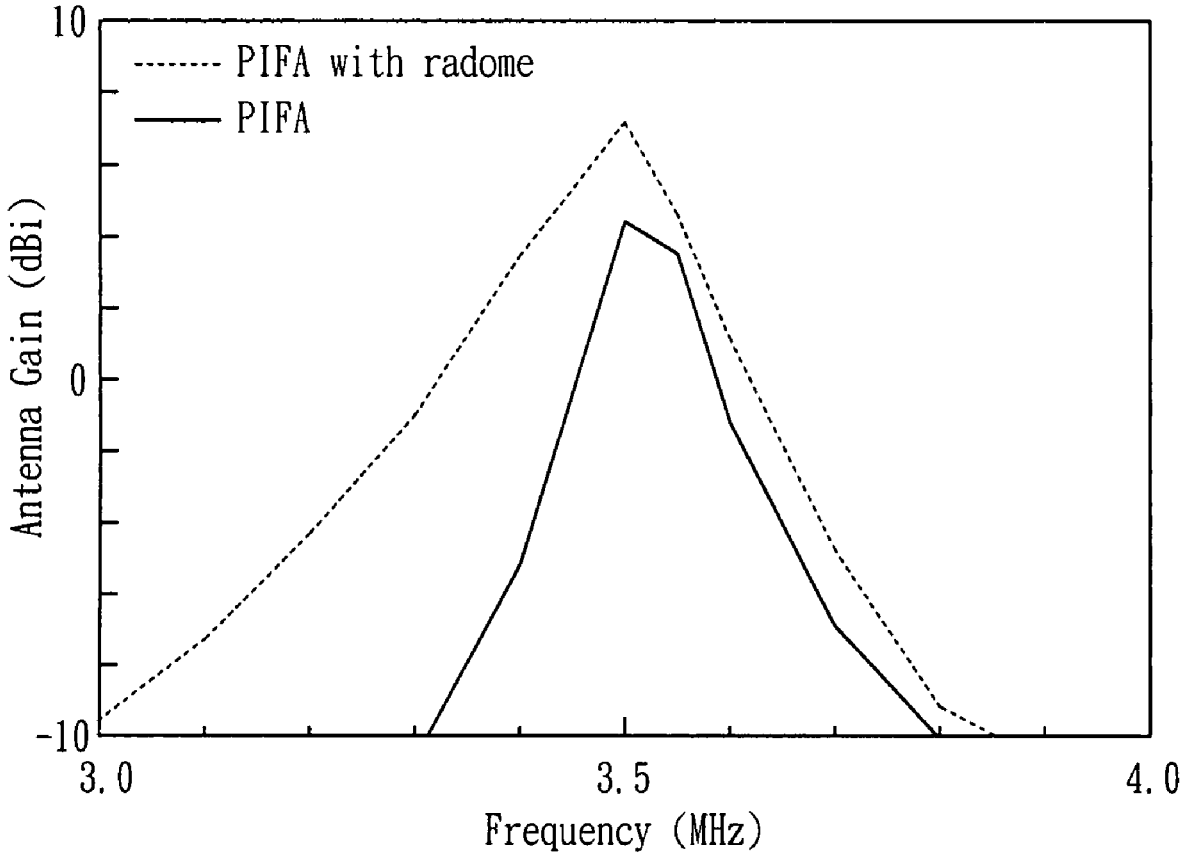

FIG. 8 illustrates the relation between antenna gain in response to frequency. At around 3.5 GHz, the FIFA has 4.4 dBi antenna gain, whereas the FIFA with antenna has 7.2 dBi antenna gain. There is an increase of around 2.8 dBi antenna gain for PIFA with radome. Therefore, the PIFA with antenna dome has higher antenna gain in comparison with that of the PIFA.

Figure 9:
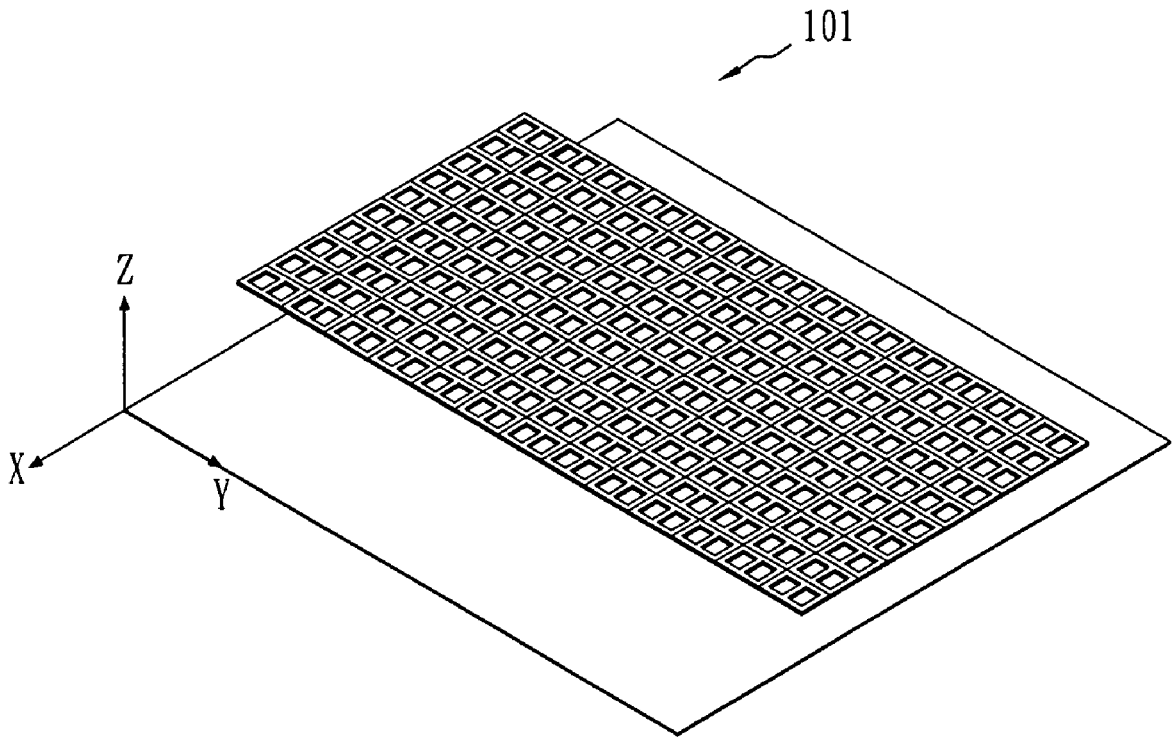
FIG. 9 shows an antenna structure of an embodiment of the invention with reference to coordinates.
Figure 10:
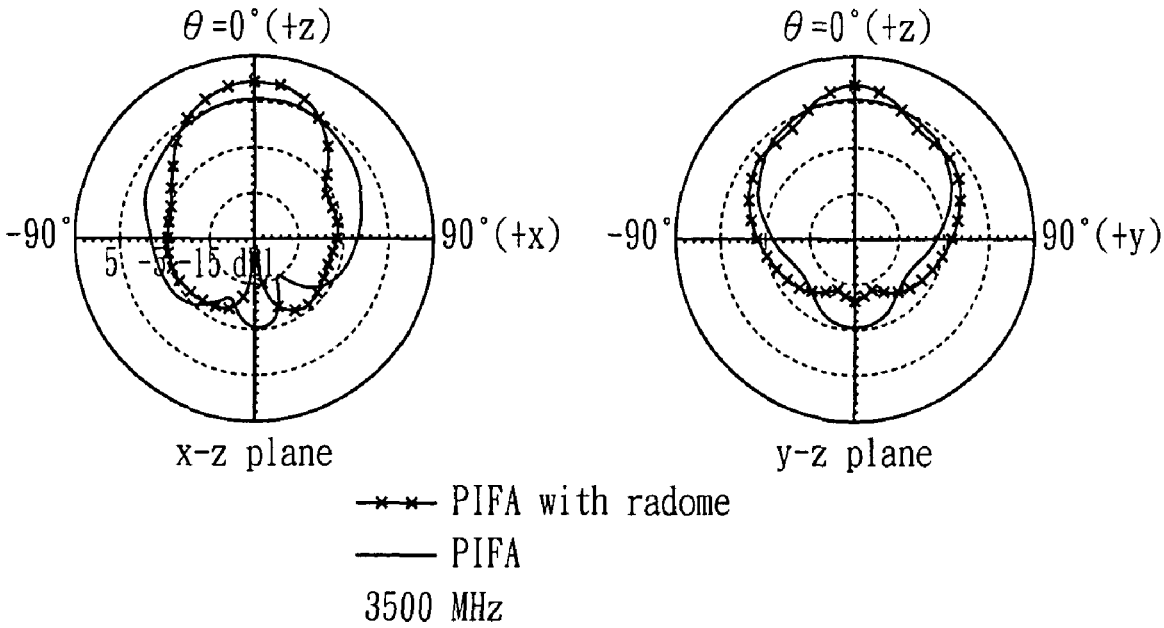
FIG. 10 shows radiation diagrams of the antenna structure shown in FIG. 9.

FIG. 9 illustrates the antenna structure 101 with reference to coordinates, and FIG. 10 illustrates the electromagnetic radiation patterns in x-z and y-z planes for PIFA and PIFA with radome (the antenna structure 101). It is seen that regardless of x-z or y-z planes the PIFA with radome has higher directionality than that of PIFA.

The PIFA has one-sided radiation due to the restriction of the grounding plane 134. Therefore, PIFA is not suitable for the applications relating to a repeat of line-of-sight or a relay station for wireless communication.

Figure 11:
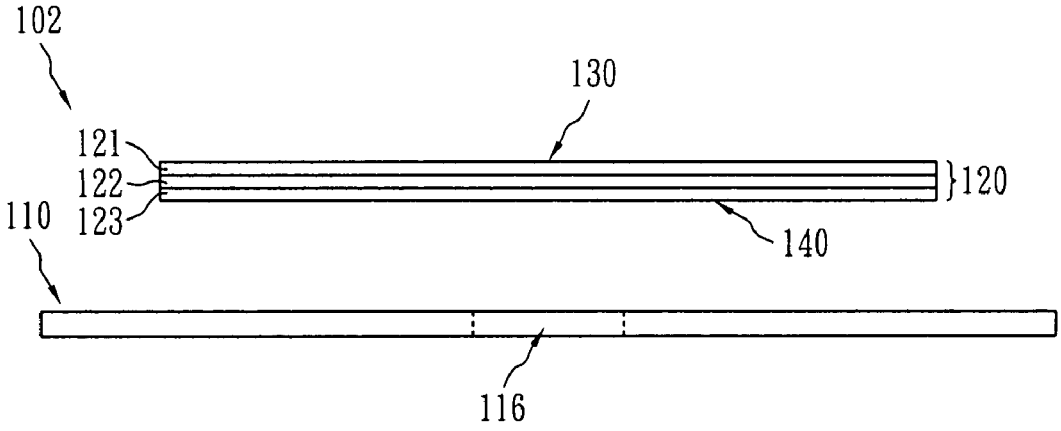
FIGS. 11 through 13 are schematic illustrations showing antenna structures according to other embodiments of the invention.

The present invention is also provided an antenna structure of double-side radiation. In FIG. 11, an antenna structure 102 comprises a radiating element 110 and a radome 120, and the gap between the radiation element 110 and the radome 120 is around 3.5 mm. In this embodiment, the antenna structure 100 has a length of around 100 mm and a width of around 86 mm. The radiating element 110 uses a slot antenna comprising a slot pattern 116, which is low-profile, wideband and has double-side radiation, to obtain the two-side radiation capability. The radome 120 comprises three dielectric layers 121, 122 and 123, and the upper surface 130 and lower surface 140 of the dielectric layers 121 and 123 are provided with S-shaped metal patterns and inverse S-shaped metal patterns. According to simulation results, the radome 120 can increase the antenna directional gain by around 4.6 dBi.

Figure 12:
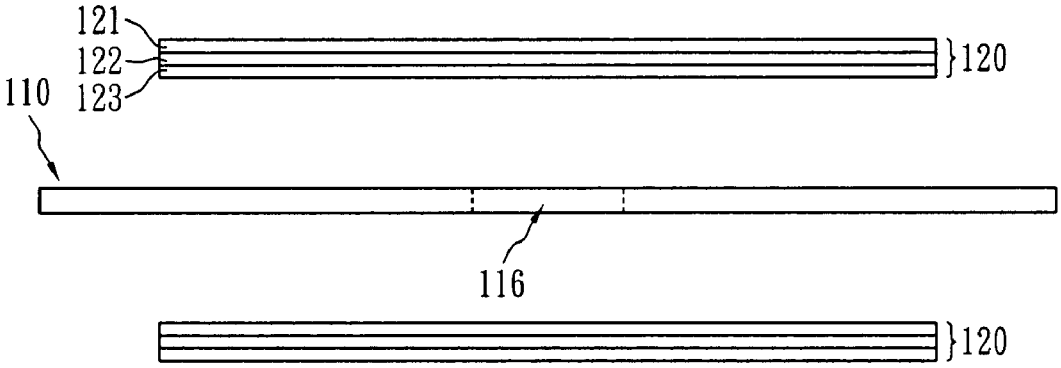

FIG. 12 illustrates an antenna structure of two-side radiation. An antenna structure comprises a radiating element 110 and two radomes 120 at two sides of the radiating element 110. According to simulation results, the radome 120 can increase the antenna directional gain by around 2.5 dBi.

Figure 13:
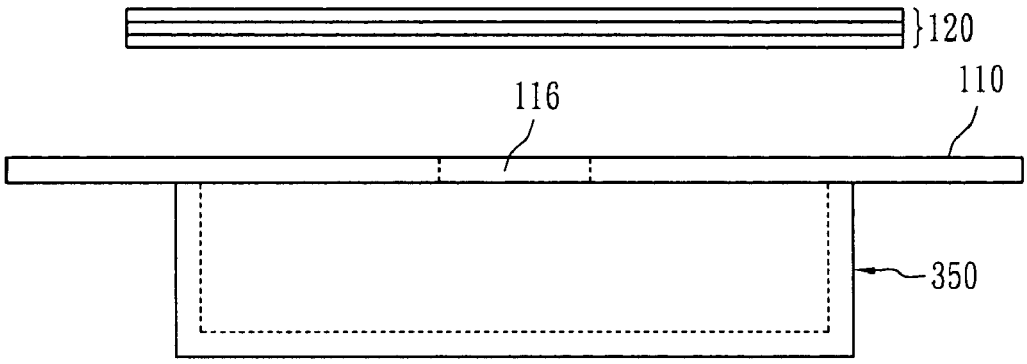

In FIG. 13, an antenna structure comprises a radiating element 110 such as a slot antenna, a radome 120 and a resonance cavity 350. A slot pattern 116 is formed in radiating element 110. The resonance cavity 350 is placed below the slot antenna 110 to reduce backside direction gain, so as to obtain specific radiation pattern for a single directional antenna.

In general, the dielectric layer 121, 122 and 123 has a dielectric constant between 1 and 100, and a magnetic coefficient between 1 and 100.

Figure 14:
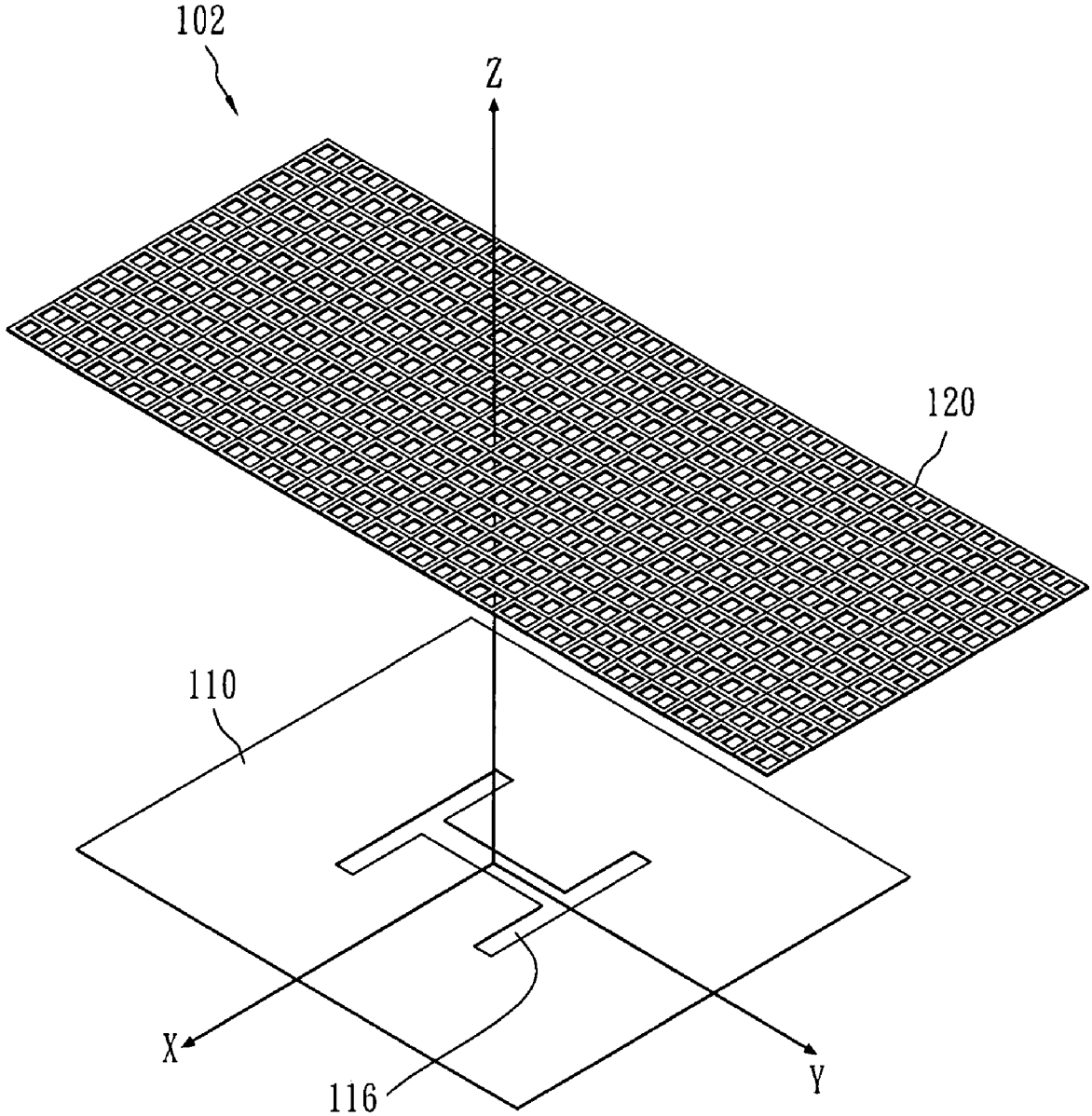
FIG. 14 shows an antenna structure of an embodiment of the invention with reference to coordinates.

FIG. 14 illustrates a three-dimensional diagram of the antenna structure 102 as shown in FIG. 11. The slot antenna 120 including a slot pattern 116. In this embodiment, the slot pattern 116 is I-shaped or H-shaped, the center of the slot pattern is connected to a signal feeding end like a microstrip. The radome 120 is placed at a near-field zone of the slot antenna 110. The slot antenna 110 may be constructed on a surface of a metallic waveguide tube, a semiconductor substrate or an outer metal layer of a coaxial cable, which is recognized as a leaky coaxial cable (LCX).

Figure 15:
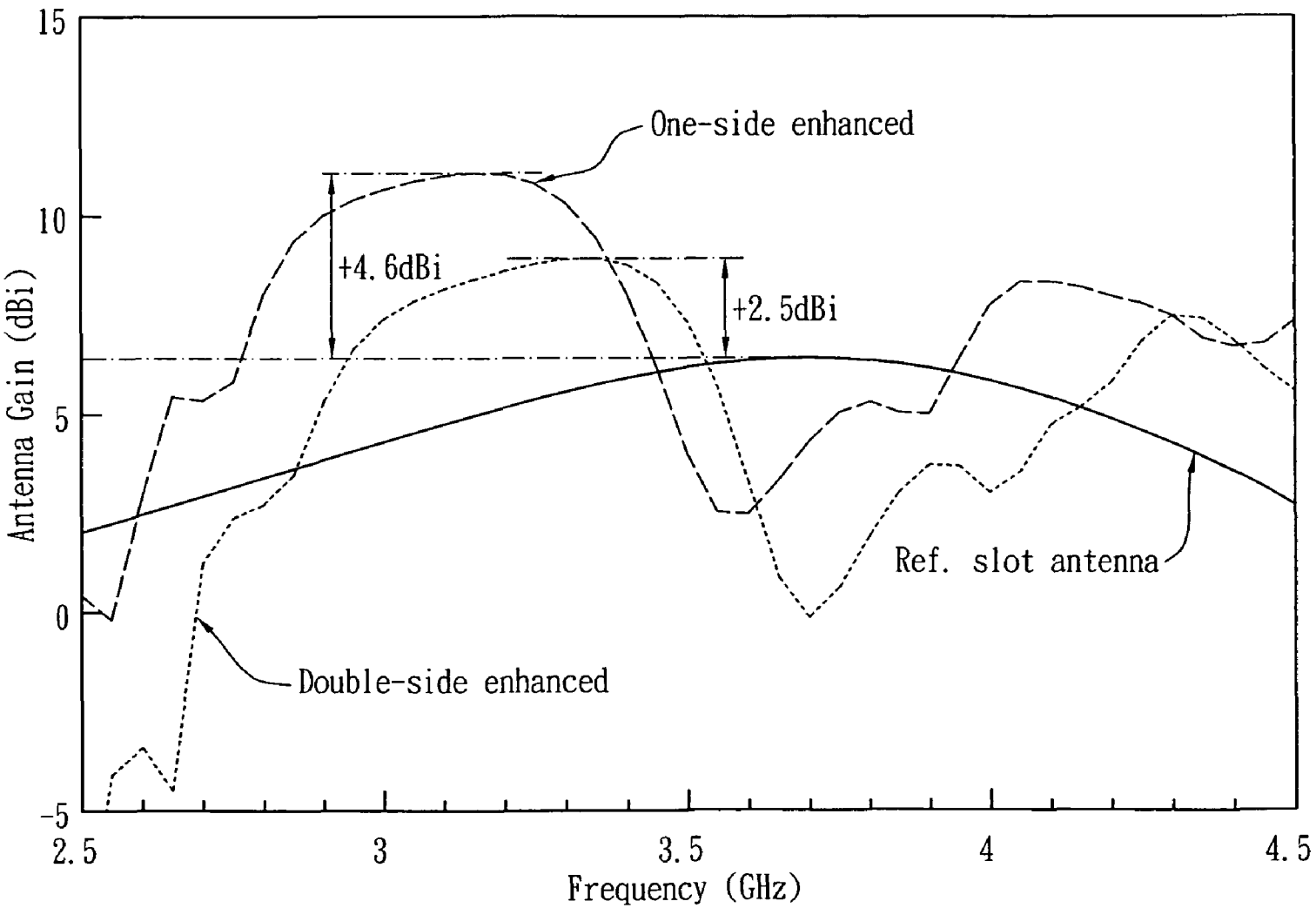
FIG. 15 shows a gain frequency response curve of the antenna structure according to an embodiment of the invention.

In FIG. 15, a slot antenna without radome has a gain of around 6 dBi at both sides. Given that the slot antenna with two radomes at both sides (double-side enhanced), the antenna gain can increase to 8.5 dBi by around 2.5 GHz. Although the gain of the antenna with one-sided radome (one-side enhanced) can increase by 4.6 dBi, the gain is only seen at one side. Therefore, the slot antenna with double-side radomes is quite suitable to be used for a relay station.

Figure 16A:
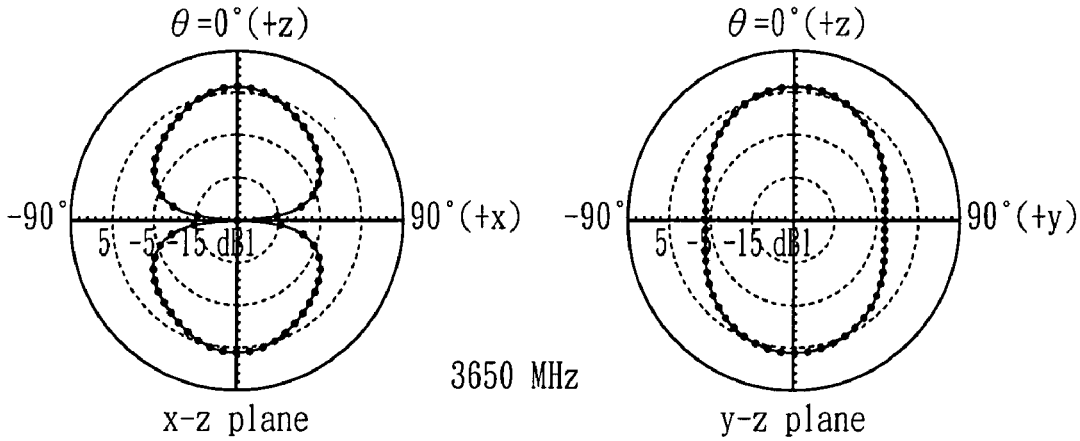
FIGS. 16A, 16B and 16C show radiation diagrams of the antenna structure shown in FIG. 14.
Figure 16B:
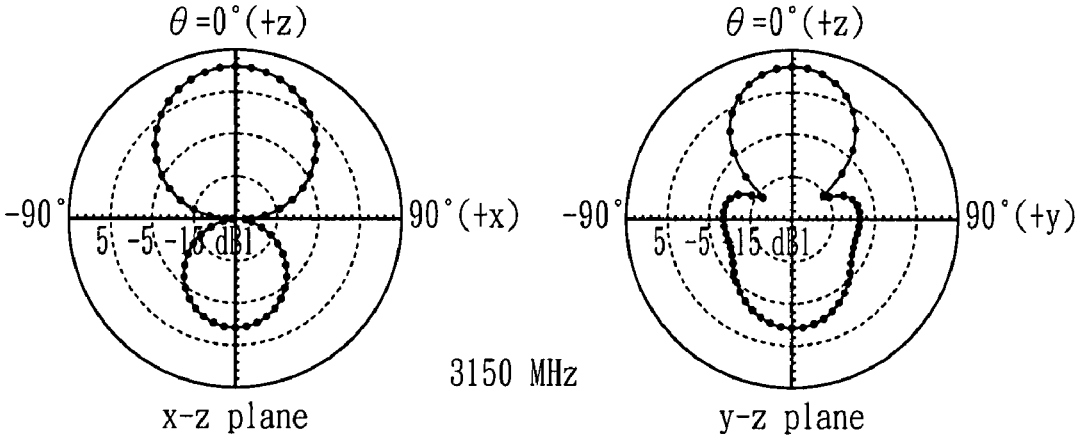
Figure 16C:
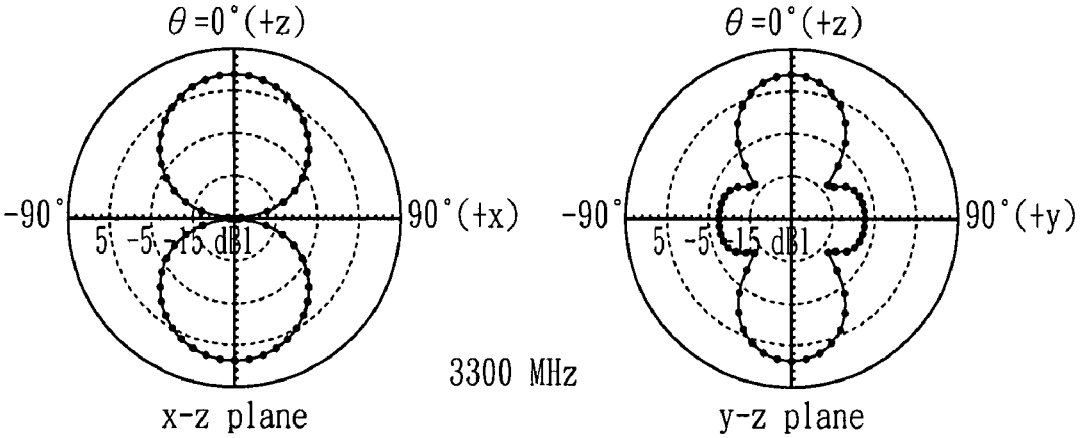

FIGS. 16A, 16B and 16C illustrate the radiation patterns of slot antenna, one-side enhanced antenna and double-side enhanced antenna at a frequency of maximum gain, respectively. It can be seen that the radiation pattern of double-side enhanced antenna has high directionality at two sides for both x-z or y-z planes.

According to the antenna structure, the antenna radome and the method of raising the gain of the antenna structure according to the embodiment of the invention, the metal patterns coupled to each other are formed on the dielectric material layer by way of printing or etching, and the antenna radome is placed in the near-field zone of the radiating field of the antenna structure to converge the beamwidth of the radiating beams outputted from the antenna structure and thus to increase the gain of the antenna structure. The metal patterns have the feature of the simple structure, and can be manufactured using the current PCB manufacturing process so that the manufacturing cost can be greatly reduced. In addition, because the antenna radome is placed in the near-field zone of the antenna structure, the size of the overall antenna structure can be further minimized, and the utility can be enhanced.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An antenna structure, comprising:

a planar inverted-F antenna; and an antenna radome having at least one dielectric layer comprising an upper surface formed with a plurality of separately single S-shaped metal patterns and a lower surface formed with a plurality of separately single inverse S-shaped metal patterns corresponding to the separately single S-shaped metal patterns, wherein the separately single S-shaped metal patterns are respectively coupled to the corresponding separately single inverse S-shaped metal patterns to converge radiating beams outputted from the radiating element.

2. The antenna structure according to claim 1, wherein a gap between the S-shaped metal patterns ranges from 0.002 to 0.2 times of a wavelength of a resonance frequency of the radiating element.

3. The antenna structure according to claim 1, wherein a gap between the inverse S-shaped metal patterns ranges from 0.002 to 0.2 times of a wavelength of a resonance frequency of the radiating element.

4. The antenna structure according to claim 1, wherein the antenna radome comprises three dielectric layers having the same magnetic coefficient.

5. The antenna structure according to claim 4, wherein the three dielectric layers are made of fiber glass.

6. The antenna structure according to claim 4, wherein the thickness ratio of the three dielectric layers is from 1:1.3:1 to 1:1.7:1.

7. The antenna structure according to claim 1, wherein the planar inverted-F antenna comprises:

a radiation conductor;

a feeding end connected to the radiation conductor;

a grounding plane; and a shorting member connected between the radiation conductor and the grounding plane.

8. The antenna structure according to claim 1, wherein the S-shaped metal patterns are lined-up in a first rectangular array and the inverse S-shaped metal patterns are lined-up in a second rectangular array, wherein the first rectangular array corresponds to the second rectangular array, wherein the first rectangular array and the second rectangular array have a longitudinal axis parallel to a longitudinal axis of the dielectric layer.

9. The antenna structure according to claim 8, wherein the corresponding first rectangular array and second rectangular array repeat on each dielectric layer.

10. An antenna structure, comprising:

a radiating element; and an antenna radome having three dielectric layers of the same magnetic coefficient comprising an upper surface formed with a plurality of separately single S-shaped metal patterns and a lower surface formed with a plurality of separately single inverse S-shaped metal patterns corresponding to the separately single S-shaped metal patterns, wherein the separately single S-shaped metal patterns are respectively coupled to the corresponding separately single inverse S-shaped metal patterns to converge radiating beams outputted from the radiating element.

11. The antenna structure according to claim 10, wherein a gap between the S-shaped metal patterns ranges from 0.002 to 0.2 times of a wavelength of a resonance frequency of the radiating element.

12. The antenna structure according to claim 10, wherein a gap between the inverse S-shaped metal patterns ranges from 0.002 to 0.2 times of a wavelength of a resonance frequency of the radiating element.

13. The antenna structure according to claim 10, wherein the three dielectric material layers are made of fiber glass.

14. The antenna structure according to claim 13, wherein the thickness ratio of the three dielectric material layers is from 1:1.3:1 to 1:1.7:1.

15. The antenna structure according to claim 10, wherein the radiating element is a planar inverted-F antenna.

16. An antenna radome, comprising:

three dielectric layers having the same magnetic coefficient;

a plurality of separately single S-shaped metal patterns formed on an upper surface of the at least one dielectric layer; and a plurality of separately single inverse S-shaped metal patterns respectively corresponding to the separately single S-shaped metal patterns and formed on a lower surface of the at least one dielectric layer, wherein the separately single S-shaped metal patterns are respectively coupled to the corresponding separately single inverse S-shaped metal patterns to converge radiating beams outputted from a radiating element.

17. The antenna radome according to claim 16, wherein the antenna radome is made of a fiber glass.

18. The antenna radome according to claim 16, wherein a gap between the S-shaped metal patterns ranges from 0.002 to 0.2 times of a wavelength of a resonance frequency of the radiating element.

19. The antenna radome according to claim 16, wherein a gap between the inverse S-shaped metal patterns ranges from 0.002 to 0.2 times of a wavelength of a resonance frequency of the radiating element.

20. The antenna radome according to claim 19, wherein the thickness ratio of the three dielectric material layers is from 1:1.3:1 to 1:1.7:1.

* * * * *